US006643992B2

(12) United States Patent
Esnault et al.

(10) Patent No.: US 6,643,992 B2
(45) Date of Patent: Nov. 11, 2003

(54) PROCESS AND MACHINE FOR FASTENING OBJECTS INTO A BOX HAVING A SQUARE OR RECTANGULAR CROSS-SECTION

(75) Inventors: Christian Esnault, La Ciotat (FR); Claude Durand, Gemenos (FR)

(73) Assignee: B Plus Development (S.A.), La Penne Sur Huveaune (FR)

( * ) Notice: Subject to any disclaimer, the term of this patent is extended or adjusted under 35 U.S.C. 154(b) by 0 days.

(21) Appl. No.: 09/972,747

(22) Filed: Oct. 8, 2001

(65) Prior Publication Data

US 2002/0062627 A1 May 30, 2002

(30) Foreign Application Priority Data

Oct. 10, 2000 (FR) ..... 00 12955

(51) Int. Cl.[7] ..... B65B 61/00

(52) U.S. Cl. ..... 53/410; 53/472; 53/474; 53/489; 53/139.5; 53/238; 53/319

(58) Field of Search ..... 53/415, 472, 474, 53/489, 139.5, 157, 238, 264, 319; 206/583, 914

(56) References Cited

U.S. PATENT DOCUMENTS 1,966,669 A * 7/1934 Johnson ..... 206/814
2,085,879 A * 7/1937 Trump ..... 53/330
2,134,908 A * 11/1938 Copeman ..... 206/583
2,423,965 A * 7/1947 Coyle ..... 53/362
3,481,100 A * 12/1969 Bergstrom ..... 53/433
3,606,724 A * 9/1971 Otto ..... 53/489
4,411,122 A * 10/1983 Cornish et al. ..... 53/526
4,724,654 A * 2/1988 Dahlin et al. ..... 53/330
4,815,251 A * 3/1989 Goodman ..... 53/238
5,226,531 A * 7/1993 Garwood ..... 53/433
5,360,115 A * 11/1994 Makino ..... 206/523
5,577,370 A * 11/1996 Pajak et al. ..... 53/478

* cited by examiner

*Primary Examiner*—John Sipos
(74) *Attorney, Agent, or Firm*—Harrison & Egbert

(57) ABSTRACT

Process for the fastening of objects into a box made of a bottom and of at least four lateral sides including introducing, into this box, a sheet of a flexible material, for example, made of cardboard, this sheet consisting of a central part having dimensions that are approximately the same as the bottom of the box, in a manner so as to be able to be displaced in a direction to the bottom of the box and, on at least two opposing sides of this central part, at least one flexible folding panel. The flexible folding panels are folded up to the top. The fastening sheet is shaped, prepared, inserted and pushed into the box until the sheet contacts the upper surface of the objects housed in the box. The folding panels are pushed back, applied and fixed, for example, by gluing, against the internal side of the lateral walls of this box, in a manner so as to create solid fixation of the fastening sheet onto the lateral walls of the box, and, as a result, the fastening of the objects housed in it.

17 Claims, 9 Drawing Sheets

PROCESS AND MACHINE FOR FASTENING OBJECTS INTO A BOX HAVING A SQUARE OR RECTANGULAR CROSS-SECTION

BACKGROUND OF THE INVENTION

1. Field of the Invention

The invention presented here relates to a process and a machine for fastening objects previously arranged inside a box made of cardboard, corrugated cardboard, or a material made of similar sheets, having a square or rectangular cross-section.

The technical domain of the invention is that of packaging machines, manufacturing machines or machines for closing packages or manufacturing or implementing fastening materials for such packages.

The invention presented here is most particularly related to the positioning of a fastening material inside boxes used for the preparation of multi-item operations and most generally of boxes whose contents have a volume that is variable from one box to the other, where this fastening material has the function of immobilizing these contents during the later manipulations of the box, for example, until it is received by the addressee.

2. Description of Related Art

It is known that the boxes of this type are formed by machines from a panel made of sheet material consisting of different folding panels or flaps assembled by gluing or by adhesive tape.

Boxes are known which, after being formed, are composed of five sides, either a bottom of a square or rectangular shape and an enclosure wall composed of four lateral sides. The known boxes of this type are called "American half-boxes", "trays" or "open boxes (caisses cloche)". These boxes are, after filling, closed by a cover. Covers are known which have four folding panels that are folded up and glued onto the sides of the box. Also, covers are known which have different previously shaped folding panels; these covers are inserted over the box and affixed to the box by gluing or by a metallic or plastic bond.

Boxes are known which, after forming, are composed of five sides, such as the boxes previously described, and of four upper folding panels. Each of these folding panels is connected to one of the lateral sides of the box by a folding line. The known boxes of this type are called "American boxes". These boxes are, after filling, closed by folding back the four upper sides that are held in position by gluing or by a metallic or plastic bond.

The boxes described above have the characteristic of providing a constant volume after manufacturing and closing.

Several mechanisms are employed by users or integrated in the machines for shaping and closing the boxes, in order to fasten the different objects whose number and unit volume varies from one box to the other.

Plastic thermo-retractable films (shrink-wraps) are known that have one or more sheets affixed with the bottom or the lateral sides of the box when it is formed. After filling the box, these films are folded back on the stack of objects and then retracted (shrunk) by passing through a heated tunnel.

Particles made of polystyrene are known which are spread on the inside of the box after filling, in order to fill the unused volume.

These manufacturing processes have numerous disadvantages because:

- these fastening materials must be necessarily disconnected from the packaging carton before the collection and recycling of the corresponding waste materials; this collection is thus a complex and very expensive operation;
- the materials used for fastening are themselves expensive; and
- their implementation is difficult and makes necessary either complex automated machines, a large number of hours of labor; the cost of these operations is thus high.

Also known are shavings, particles, chipboard balls, etc., of paper, cardboard, or wood, which are, in various forms, arranged inside the boxes in order to fill the unused volume.

These manufacturing processes also have several disadvantages because:

- the dosage of the distribution of these fastening materials, in a manner so as to exactly occupy the unused volume, is an operation that is difficult to automate which requires either complex automated machines or a large number of hours of labor; the cost of these operations is thus high; and
- the collection of these materials after opening the package requires the gathering of a multitude of scattered elements and is thus an operation that is not very easy to do for the end user.

The problem posed thus consists in obtaining a mechanism for fastening the objects to the inside of the boxes used for the shipment of parcels whose useful volume is variable, and in making sure that this fastening mechanism and its implementation are not very expensive and generate a minimum of restrictions for those who create the packaging prior to shipment and for those who open the packaging upon receiving the parcel.

BRIEF SUMMARY OF THE INVENTION

The solution to the problem posed consists in obtaining a process for inserting inside of a box composed of a bottom having a square or rectangular shape or approximately square or rectangular, and of at least four lateral sides, a cardboard sheet, corrugated cardboard or equivalent sheet material, this sheet put in contact with the upper surface of the stack of objects arranged in the box and then connected solidly to this box in a manner so as to ensure that the objects are fastened.

The process used in order to insert this sheet inside the box is characterized in that:

- this sheet has a central part in the shape of a square or rectangle, or approximately square or rectangular, having dimensions that are approximately equivalent to those of the bottom of this box, in a manner so as to be able to be introduced into this box and moved in translation in a direction to the bottom of it;
- this sheet consists of, around this central part, and on at least two of the two opposing sides, and preferably, on its four sides, at least one and preferably, several flexible folding panels;
- this sheet is inserted and pushed into the box, in deforming it, if necessary, in a manner so that the inside of the central part comes in contact with stack of objects and approximately fits the shape of the upper surface of this stack of objects; and
- these folding panels are folded up and affixed against the inner side of the lateral walls of the box, so as to create the solid fixation of the fastening sheet on these lateral walls and, as a result, the fastening of the objects housed in this box.

In a preferred embodiment mode of the process of the invention, on the lower side of the flexible folding panels, prior to introducing the fastening sheet of the box, one or more dots or beads of glue are arranged so as to create, after the introduction and the pushing of the fastening sheet into the box, the application of the flexible folding panels pasted against the internal side of the lateral walls of the box and the drying of the glue, a solid fixation of the fastening sheet on the lateral walls of the box.

In an advantageous embodiment mode, these folding panels of the sheet comprise one or more folding lines parallel to the joints of the folding panels relative to the central part of the sheet, these folding lines making it possible to reduce the surface of these folding panels applied against the four lateral sides of the box and to use the surface that is thus available in order to compensate for the increase of the surface of the central part of the sheet associated with its deformation when it is put in contact with the upper surface of the stack of objects.

According to another characteristic arrangement of the process of the invention, the fastening sheet is pressed at several points of the surface of its central part, against the upper surface of the objects housed in the box, in a manner so as to be deformed and to fit the shape of the upper surface.

Advantageously, these sheets are previously stored in the form of a stack of identical sheets arranged inside an inclined bin and the sheet located at the bottom part of this bin is unstacked individually by the action of a mobile plate equipped with suctions that are positioned so as to allow the sheet to be disconnected from the stack of sheets and to arrange the sheet on a horizontal plane made of several rails, and the arrangement of the dots or beads of glue on the lower side of each of the folding panels is produced during the transfer of the sheet into the horizontal plane, by the action of gluing nozzles located under the horizontal plane and aimed at the folding panels. The transfer is created by the displacement of mobile stops and also has the function of positioning the sheet above the box.

Advantageously, after the transfer of the sheet above the box:

a tool, previously placed above the box in its initial position, consists of a grasping plate equipped with suctions, and these suctions are put in contact with the sheet by a vertical translation movement of the tool towards the bottom in order to ensure a seating of the sheet;

the tool also consists of mobile arms, these mobile arms are approximately the same number as the total number of the folding panels of the sheet, and are positioned approximately facing each of the folding panels, the mobile arms each having a support plate, and the support plates are put in contact with the zone of the central part of the sheet located near each of the folding panels by the tool's vertical translational movement towards the bottom;

pushing mechanisms are arranged around the sheet facing each of the folding panels and these pushing mechanisms are activated, from their position of rest, in order to obtain a fold of the folding panels;

the mobile arms also each have a support device equipped with a suction and, with the help of the support devices, a support of the folding panels is ensured after the fold; and the pushing mechanisms are put into the resting position.

Advantageously, the box has been previously positioned on an elevator in order to insert the sheet into the box:

using this elevator, a lift of the box is ensured in a manner so that the upper surface of the stack of objects comes in contact with the lower side of the central part of the sheet;

the lift of the box also produces a lift of the tool in a manner so that the largest part of the lower side of the central part of the sheet is pinned against the upper surface of the stack of objects by the vertical force produced by the action of these support plates of the mobile arms on the central part, the vertical force can be generated by any appropriate mechanism such as tare weight of the mobile arms and the support plates, which can be displaced vertically relative to the grasping plate;

the supporting devices each have an activator, and the output of these activators is controlled, after the lift of the box, in order to fold up the folding panels, by pushing the supporting devices in a manner so that the glued side of the folding panels comes in contact with the four lateral sides of the box;

waiting is done until the drying of the dots or beads of glue, where the drying makes it possible to connect the sheet to the box;

the action of the suctions of the supporting devices is released and the return of the activators is controlled;

the action of the suctions of the grasping plate is released;

using the elevator, the bringing back down of the box and the sheet is ensured; and the bringing back down of the box also produces the bringing back down of the tool until its initial position.

As a result of these operations, the sheet has been inserted inside the box, deformed, and pinned against the upper surface of the stack of objects, then connected solidly with the box by gluing of the folding panels of the sheet against the lateral sides of the box.

The fastening process according to the invention produces several advantages.

Thus, using the invention, the objects arranged inside the box are perfectly fastened using a sheet whose purchase and implementation are not very expensive and which does not lead to any particular restriction connected to the collection and the recycling of waste material generated by the destruction of the packaging after its use.

The invention presented involves moreover, a machine for inserting, inside a box composed of a bottom having a square or rectangular shape, and of four lateral sides, a cardboard sheet, corrugated cardboard or equivalent sheet material, where this sheet has a central part in a square or rectangular shape with dimensions that are approximately equivalent to those of the bottom of the box, consisting of, around the central part, and on at least two of its four sides, at least one and preferably several flexible folding panels and it is put into contact with the stack of objects arranged in the box and then connected solidly to this box.

This machine is characterized in that it consists of:

mechanisms for arranging, on the lower side of each of the folding panels, one or more dots or beads of glue, mechanisms for folding the folding panels and supporting mechanisms in a manner so that the non-glued side of the folding panels forms an angle less than 90 degrees with the upper side of the central part, before insertion of the sheet in the box;

mechanisms for inserting the sheet into the box, while deforming it, if need be, in a manner so that the inner side of the central part comes into contact with the stack of objects and fits approximately the shape of the upper surface of the stack of objects; and mechanisms for folding up the folding panels in a manner so that their glued side comes in contact with the four lateral sides of the box.

In an advantageous embodiment mode, the machine consists of:

an inclined bin for the storage of the sheets in the form of the a stack of identical sheets and a mobile plate equipped with suctions that are positioned so as to make it possible to disconnect the sheet located on the lower part of the bin from the stack of sheets;

a horizontal plane of transfer consisting of several rails;

gluing nozzles located under the horizontal plane and aimed at the folding panels, for depositing the dots or beads of glue on the inner side of each of the folding panels during the transfer of the sheet into the horizontal plane; and mobile stops to ensure the transfer of the sheet in the horizontal plane and the positioning of the sheet above the box.

Advantageously, the machine consists of a tool, previously arranged above the box in its initial position. This tool consists of:

a grasping plate equipped with suctions that are put in contact with the sheet by a vertical translation movement towards the bottom of the tool in order to ensure a seating of the sheet;

mobile arms of the same number as the total number of folding panels of the sheet, where the mobile arms are positioned approximately facing each of the folding sheets and each having a support plate that is in contact with the zone of the central part of the sheet located near each of the folding panels by the vertical translation movement towards the bottom of the tool;

supporting devices equipped with suctions for supporting the folding panels after the fold; and activators, the output of which is controlled in order to fold the folding panels, by pushing the supporting devices, in a manner so that the glued side of the folding panels comes in contact with four lateral sides of the box.

Advantageously, the machine also consists of:

pushing mechanisms which are arranged around the sheet facing each of the folding panels and are activated, from their resting position, in order to create the fold of the folding panels; and an elevator, which ensures a lift of the box and of the tool in a manner so that the largest part of the lower side of the central part of the sheet is deformed and pinned against the upper surface of the stack of objects by the vertical force produced by the action of the support plates of the mobile arms on the central part, the vertical force can be generated by any appropriate means such as the tare weight of the of the mobile arms and the support plates, which can be displaced vertically relative to the grasping plate.

The advantages produced by the invention are better understood using the following description which refers to the attached drawings, which show, in a non-restrictive manner, a particular embodiment mode of a machine according to the invention.

BRIEF DESCRIPTION OF THE SEVERAL VIEWS OF THE DRAWINGS

In these drawings, identical references designate equivalent elements.

DETAILED DESCRIPTION OF THE INVENTION

Figure 1:
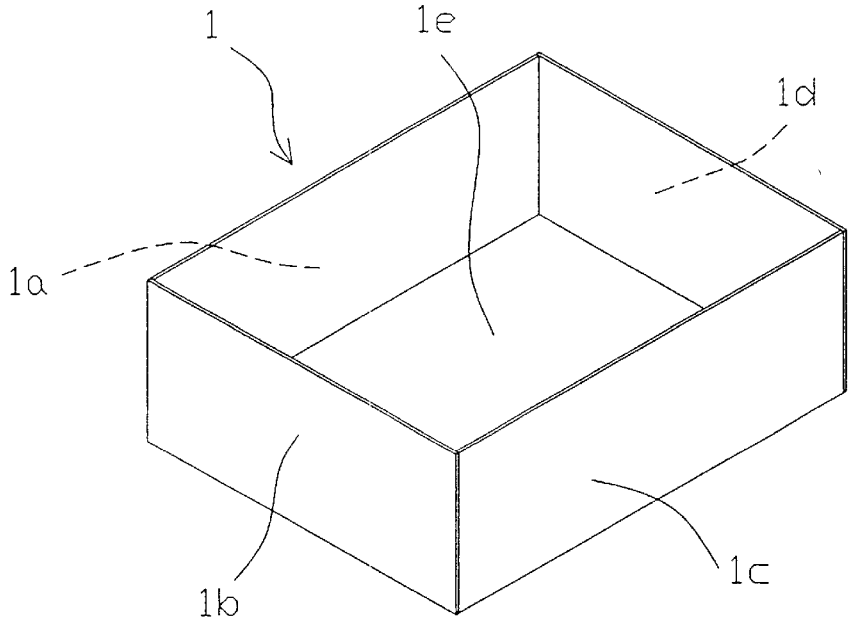
FIG. 1 is a schematic view of a box that can be used to implement the process and the machine according to the invention.

FIG. 1 shows the box 1 used by the machine according to the invention. The box 1 is composed of at least five sides, i.e. at least four lateral sides 1*a*, 1*b*, 1*c*, and 1*d* and a bottom 1*e*. According to the example shown, the bottom has a rectangular shape, in a manner so that the box has the shape of a right-angled parallelepiped. It is emphasized that the bottom can have a square shape or an approximately rectangular or square shape, for example, a general square or rectangle shape with angles cut off, the box thus having the shape of a right parallelepiped with cut off edges and consisting of actually eight sides (four large and four small).

Figure 2:
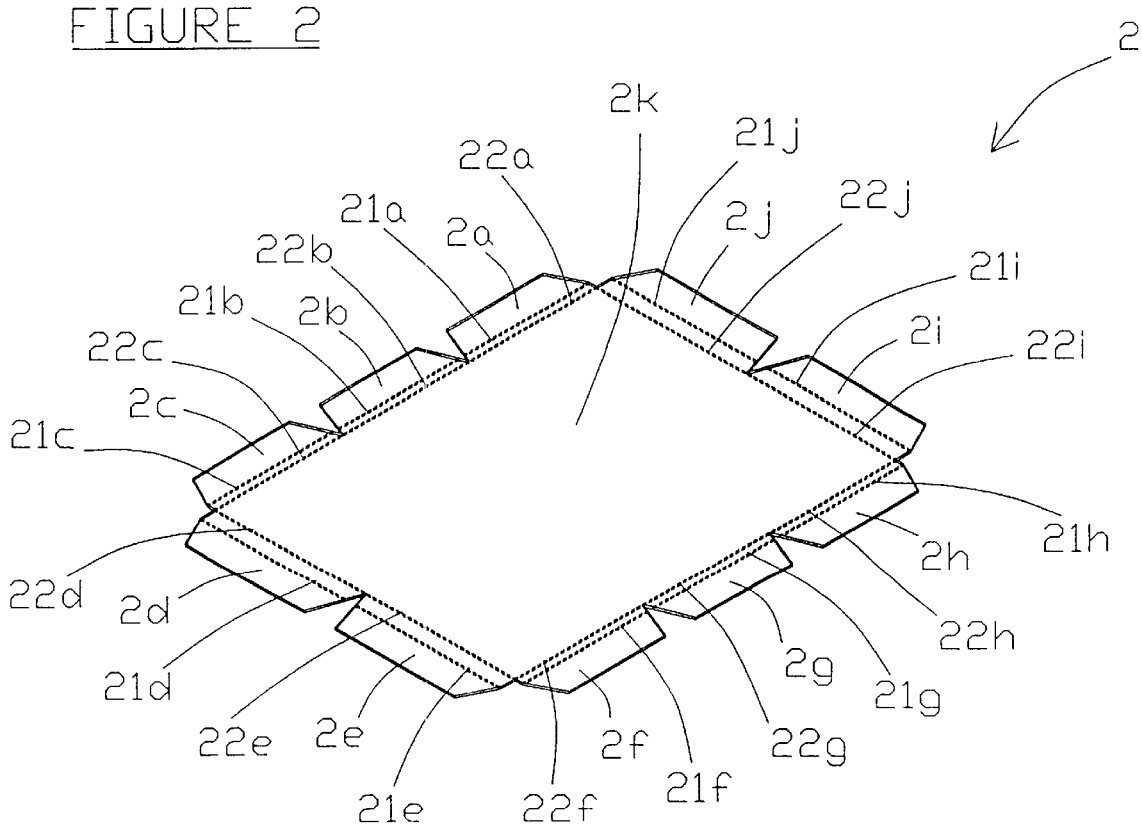
FIG. 2 is a schematic view of a sheet that is used for the fastening of objects in a box, according to the process and using the machine according to the invention.

FIG. 2 shows an adaptation example a sheet 2 that can be used to implement the process and the machine according to the invention. The sheet 2 consists of a central part 2*k* having dimensions approximately equivalent to those of the bottom 1*e* of the box 1. The sheet 2 also consists of, on at least two of its opposite sides, at least one flexible folding panel. According to the advantageous example shown, it is apparent that the fastening sheet 2 has flexible folding panels 2*a*, 2*b*, 2*c*, 2*d*, 2*e*, 2*f*, 2*g*, 2*h*, 2*i*, and 2*j* on each of its sides. Also shown are the joints 22*a*, 22*b*, 22*c*, 22*d*, 22*e*, 22*f*, 22*g*, 22*h*, 22*i*, and 22*j* of the folding panels relative to the central part. Also shown according to another characteristic arrangement are the folding lines 21*a*, 21*b*, 21*c*, 21*d*, 21*e*, 21*f*, 21*g*, 21*h*, 21*i* and 21*j* on the folding panels which are parallel to the joints.

As indicated previously, this sheet 2 can be made of cardboard, corrugated cardboard, or any other equivalent sheet material.

Figure 3:
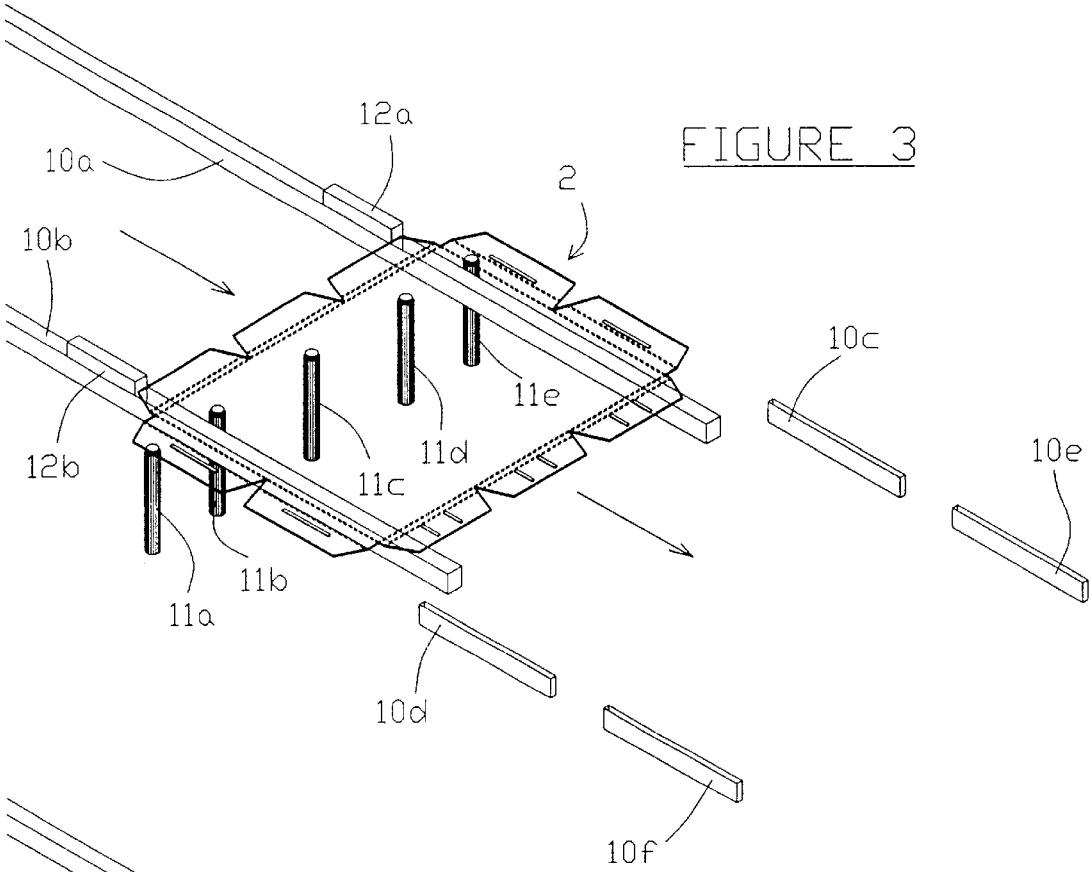
FIGS. 3 and 4 are schematic views of a same part of a machine according to the invention, having two successive stages of the functioning cycle.
Figure 4:
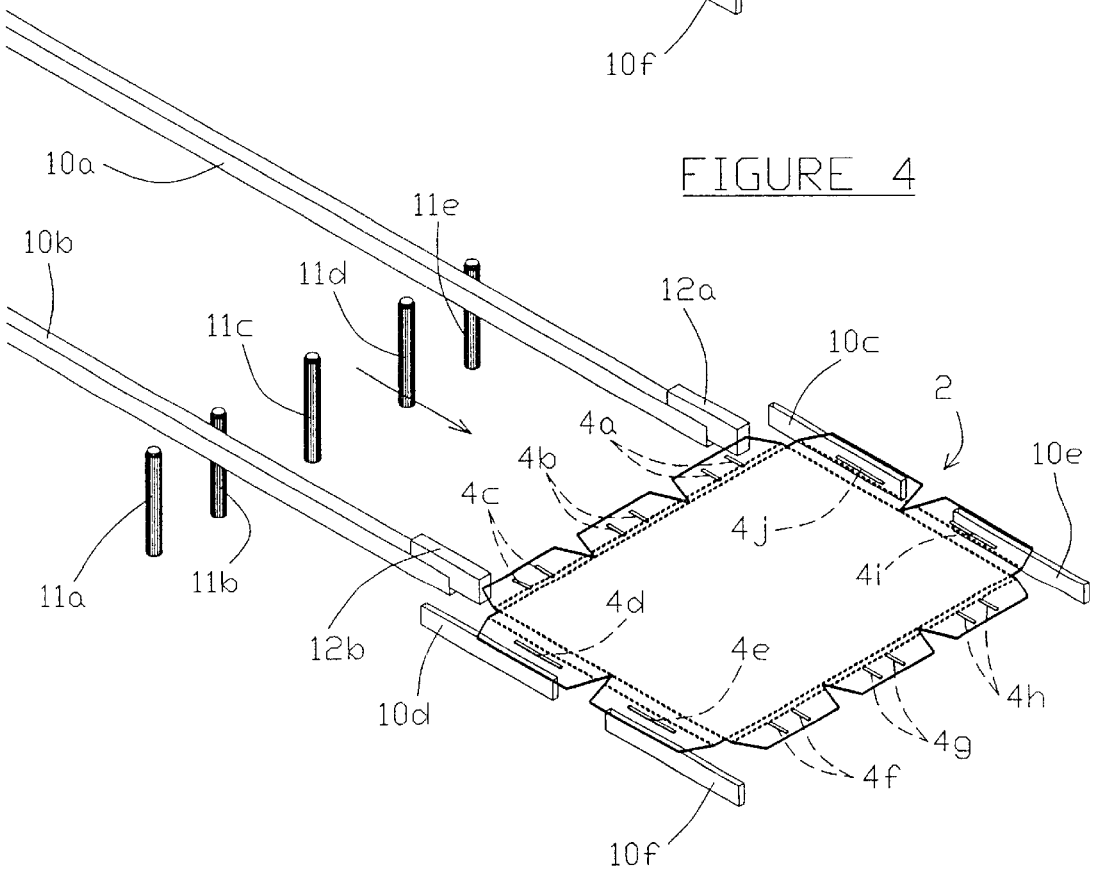

FIGS. 3 and 4 show a part of the machine used to transfer the sheet 2 and the gluing of these folding panels. Shown in FIGS. 3 and 4 is the horizontal transfer plane consisting of the rails 10*a*, 10*b*, 10*c*, 10*d*, 10*e* and 10*f*. Also shown are the mobile stops 12*a* and 12*b* sliding on the rails 10*a*, 10*b*, whose displacement, which can be produced for example, by the action of a pneumatic jack, ensures the transfer of the sheet 2. Also shown are the gluing nozzles 11*a*, 11*b*, 11*c*, 11*d* and 11*e* located under the horizontal plane and aimed at the folding panels. FIG. 3 shows the sheet 2 when it progresses to the vertical of the gluing nozzles. FIG. 4 shows the sheet 2 after complete gluing and at the end of the transfer. Also shown in FIG. 4 are the beads of glue 4*a*, 4*b*, 4*c*, 4*d*, 4*e*, 4*f*,

4*g*, 4*h*, 4*i* and 4*j* arranged on the inner side of the folding panels by projection under pressure of the glue by the gluing nozzles.

The rails 10*c*, 10*d*, 10*e*, 10*f* comprise the terminal portion of the horizontal plane for transfer and supply, have a gauge of a slightly larger dimension than that of the rails 10*a*, 10*b* forming the initial part of the horizontal plane, and are arranged on both sides of the space where the insertion of the fastening sheet 2 is made.

Figure 5:
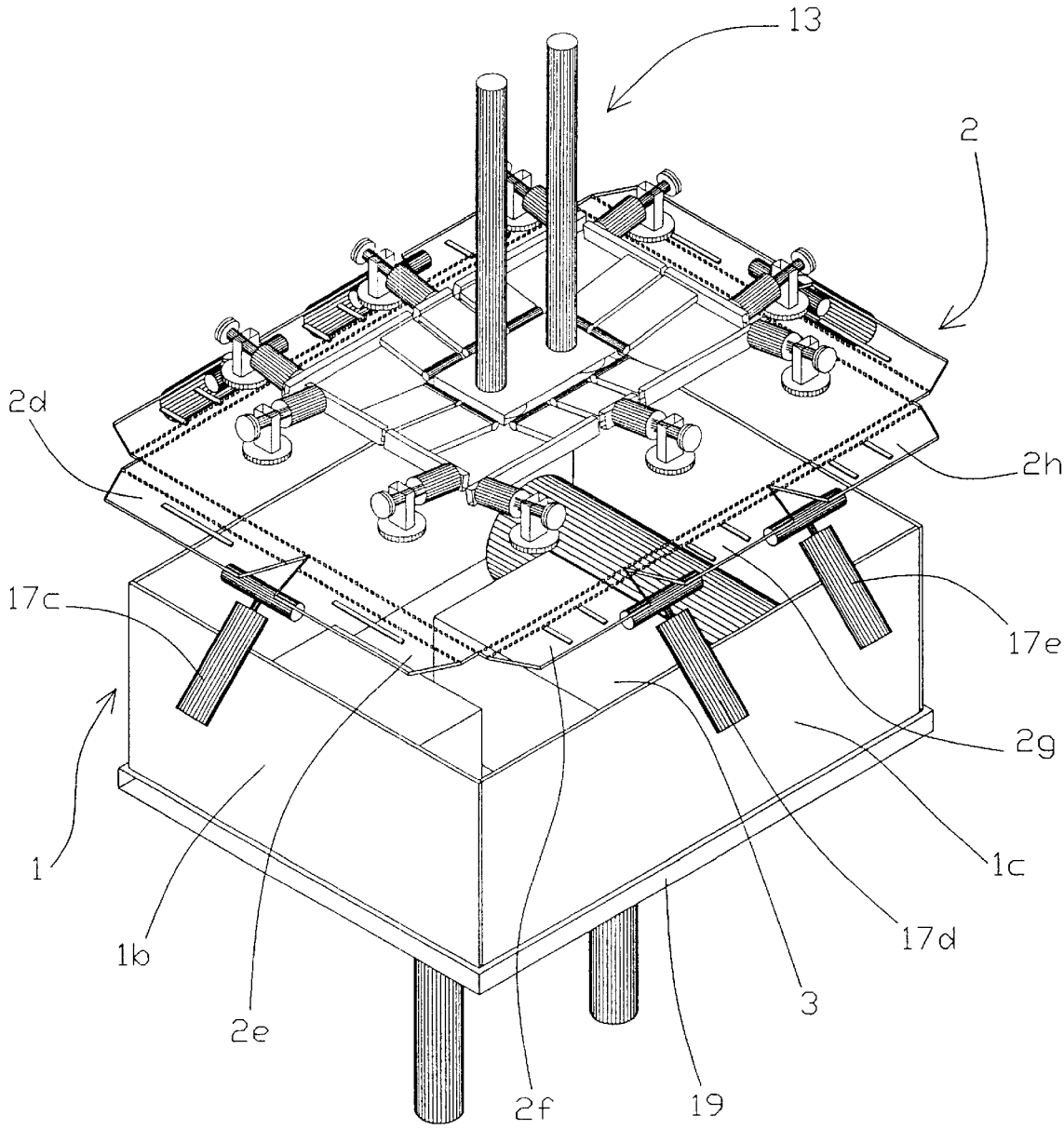
FIG. 5 is schematic view of another part of this machine.

FIG. 5 shows the part of the machine used for the insertion of the sheet 2 in the box 1. This drawing shows the tool 13 arranged beforehand above the box 1. This part of the machine consists of several pushing mechanisms making it possible to fold up the folding panels of the fastening sheet 2. Notably shown are the pushing mechanism 17*c* used to fold up the folding panels 2*d* and 2*e* and the pushing mechanisms 17*d* and 17*e* used to fold up the folding panels 2*f*, 2*g*, and 2*h*. Finally shown is the elevator 19 arranged below the tool 13 and on which the box 2 has been positioned.

Figure 6:
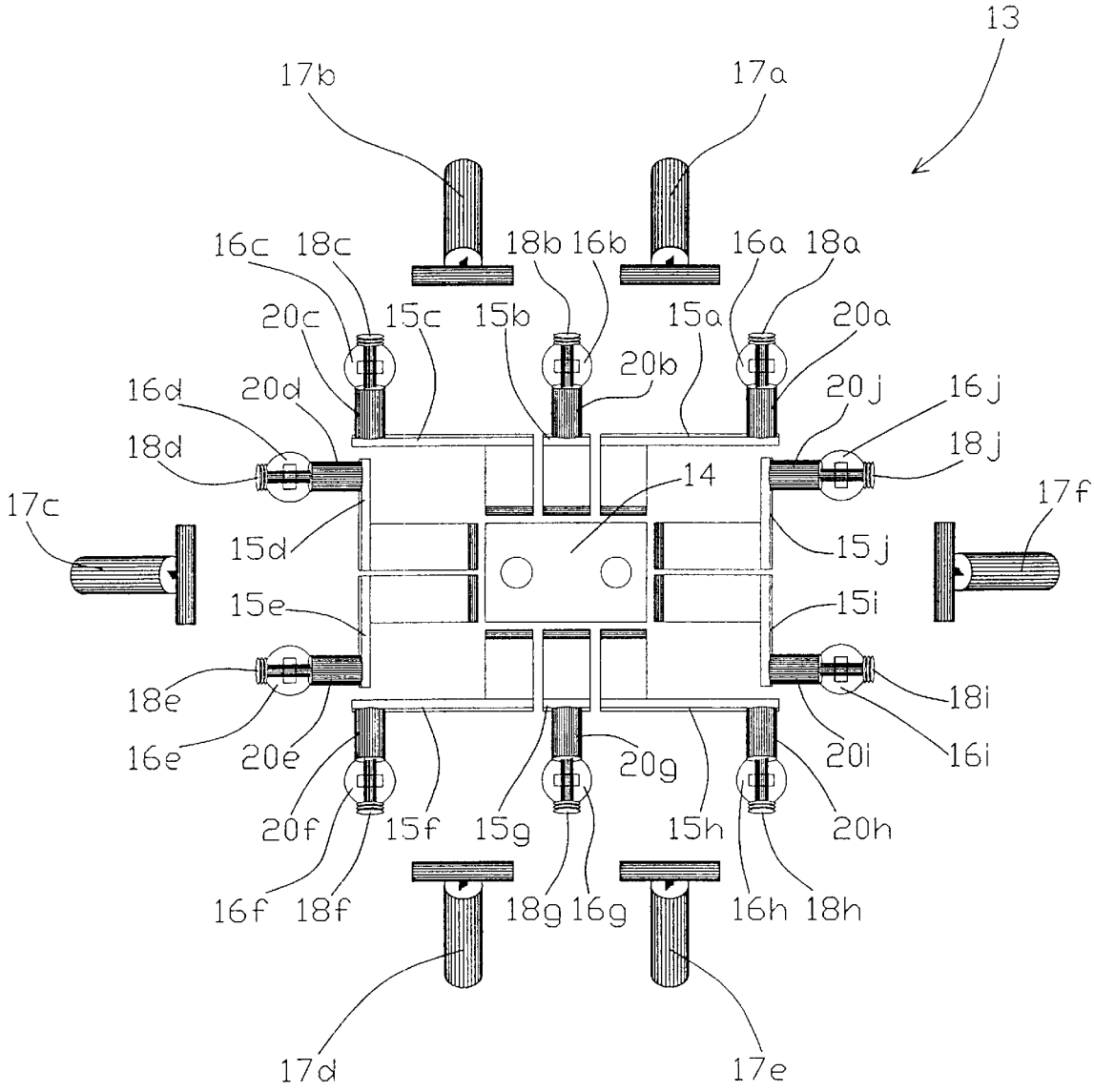
FIG. 6 is a top plan view of the part of the machine shown in FIG. 5.

FIG. 6 also shows the part of the machine used for the insertion of the sheet 2 into the box 1. This Figure Shows the Tool 13 Consisting of:

- a grasping device arranged in the central zone of the tool and, for example, consisting of a grasping plate 14 that make it possible grasp the fastening sheet 2;
- mobile arms 15*a*, 15*b*, 15*c*, 15*d*, 15*e*, 15*f*, 15*g*, 15*h*, 15*i* and 15*j* equipped with support plates, support devices, and activators, these mobile arms being spread out around the horizontal grasping plate 14 and connected to it by the joints that allow their pivoting in the vertical planes; shown are, more precisely:
  - support plates 16*a*, 16*b*, 16*c*, 16*d*, 16*e*, 16*f*, 16*g*, 16*h*, 16*i* and 16*j* making it possible to exert a counter-pressure on the zones distributed around the center of the central part 2*k* of the fastening sheet 2; and
  - supporting devices 18*a*, 18*b*, 18*c*, 18*d*, 18*e*, 18*f*, 18*g*, 18*h*, 18*i* and 18*j* that ensure the support in the folded back position of the fastening folding panels 2, after folding these panels by the action of the pushing mechanisms; and activators 20*a*, 20*b*, 20*c*, 20*d*, 20*e*, 20*f*, 20*g*, 20*h*, 20*i* and 20*j*, making it possible to fold up and apply the glued folding panels of the fastening sheet 2, against the inner side of the lateral walls of the box during the duration required for the rapid glue to set (a few seconds).

Also shown are all of the pushing mechanisms 17*a*, 17*b*, 17*c*, 17*d*, 17*e* and 17*f*.

FIGS. 7 to 15 also show the part of the machine used to insert the sheet 2 into the box 1, by nine successive stages of the functioning cycle.

In order to simplify the account of the functioning of the machine of the invention, the description made for the FIGS. 7 to 15 relates to the action of the different active elements of the machine on one of the folding panels (folding panel 2*d*) of the sheet 2. The action of the other similar elements of the machine on the other folding panels is, of course, similar and simultaneous.

Notably shown are, in these drawings, the box 1 positioned on the elevator 19 and the lateral side 1*b* of the box 1. Also shown are the sheet 2, the central part 2*k* of it and the folding panel 2*d*, as well as a bead of glue 4*d* applied on the lower side of it. Shown again is the stack of objects 3 previously arranged inside the box 1. Also shown are the tool 13 equipped with the grasping plate 14, the mobile arm 15*d*, the support plate 16*d*, the support device 18*d*, and the activator 20*d*. Finally, the pushing mechanism 17*c* is shown.

Figure 7:
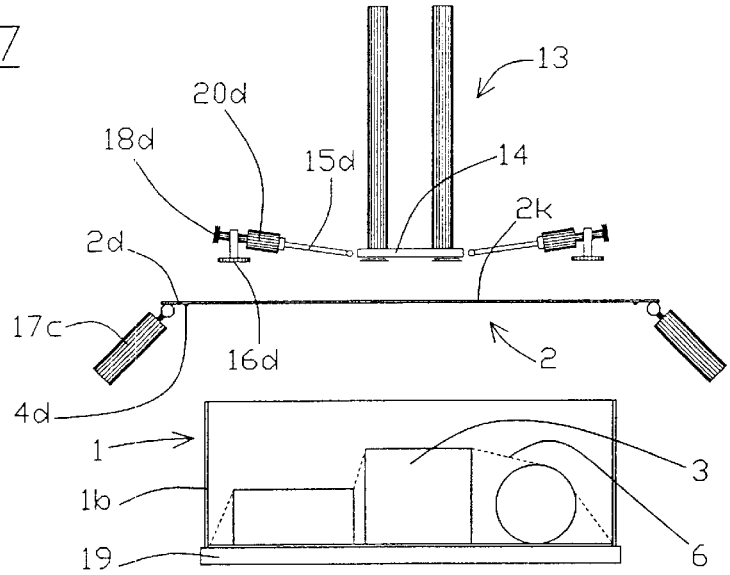
FIGS. 7 to 15 are sectional views of a same part of the machine according to the invention, having nine successive stages of the functioning cycle.

Shown in FIG. 7 is the tool 13 in the initial position and the sheet 2 resting on the pushing mechanisms (pushing mechanism 17*c*, . . . ) and on the rails 10*c*, 10*d*, 10*e*, 10*f*, by the intermediary of its folding panels and positioned above the box 1 after the stage of gluing and transfer. Also shown is the upper irregular surface 6 of the stack of objects (3) housed in the box.

Figure 8:
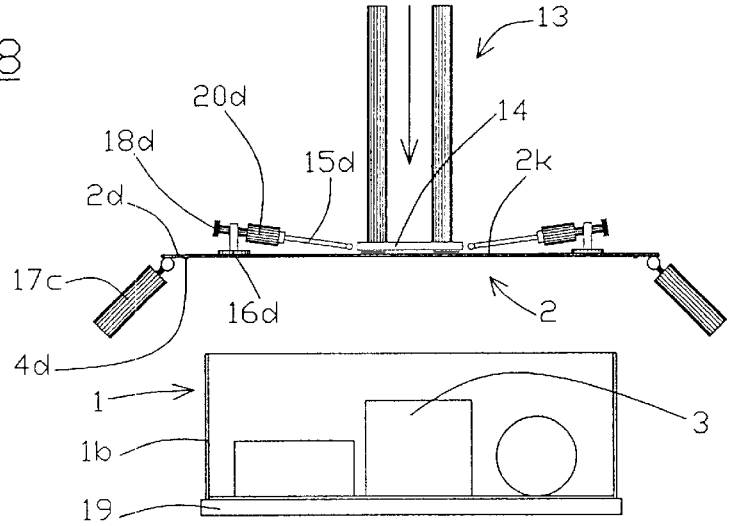

FIG. 8 shows the putting into contact of the grasping plate 14 and the support plates (support plate 16*d*, . . . ) with the sheet 2 produced by a controlled movement in vertical translation of the tool 13 towards the bottom under the action, for example, of gravity.

Figure 9:
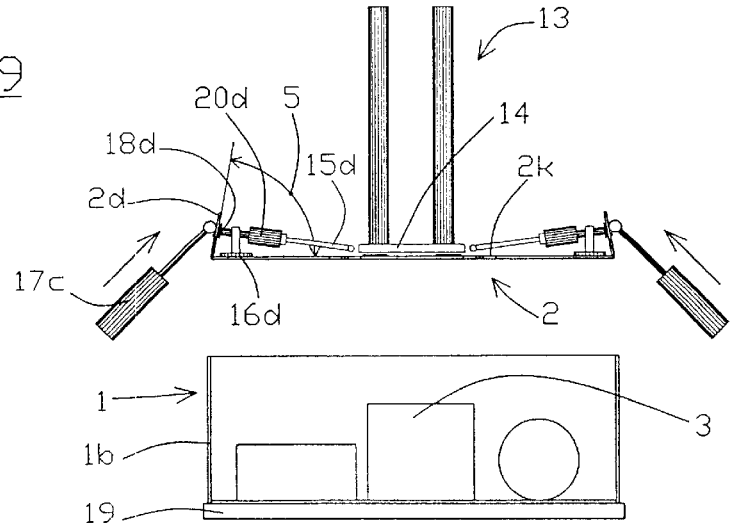

FIG. 9 shows the fold of the flexible folding panels (folding panel 2*d*, . . . ) by the action of the pushing mechanisms (pushing mechanism 17*c*, . . . ), produced, for example, by a pneumatic jack, in a manner so that the angle 5 between the upper side of the folding panels and the upper side of the central part 2*k* of the sheet 2 is less than 90 degrees.

Figure 10:
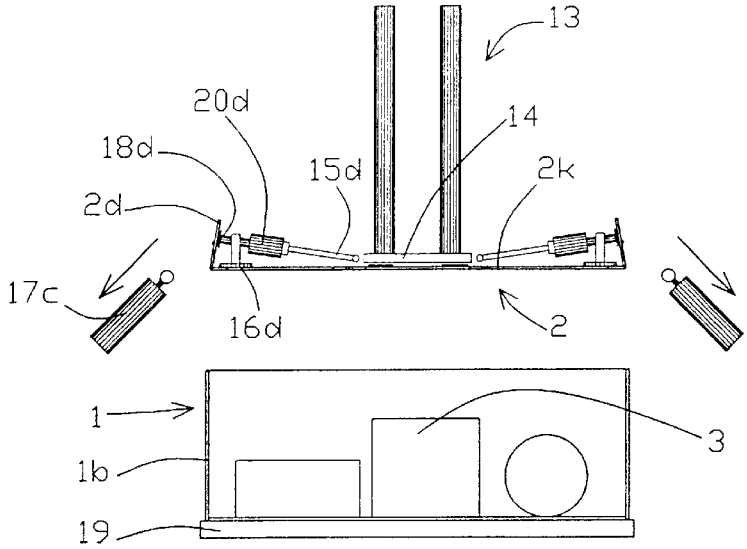

FIG. 10 shows the return of the pushing mechanisms (pushing mechanism 17*c*, . . . ) to the rest position and the support of the folding panels (folding panel 2*d*, . . . ) by the support devices (support devices 18*d*, . . . ) equipped with a suction.

Figure 11:
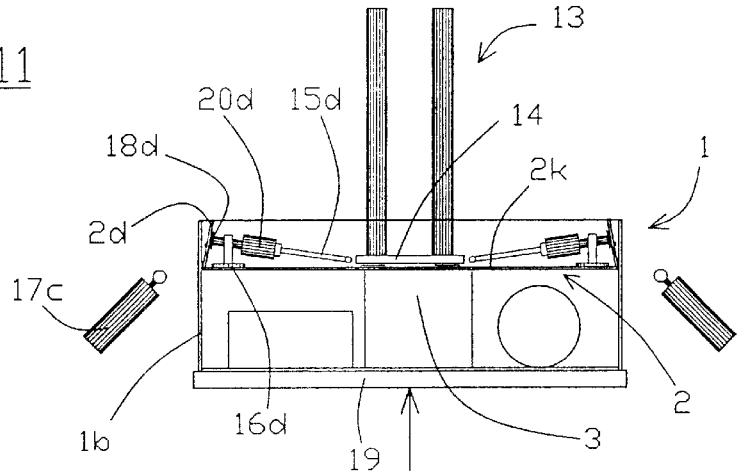

FIG. 11 shows the lift of the box 1 carried by the elevator 19, whose movement is produced, for example, by an electric jack, and putting into contact with the lower side of the central part 2*k* of the sheet 2 with the upper side and the stack of objects 3.

Figure 12:
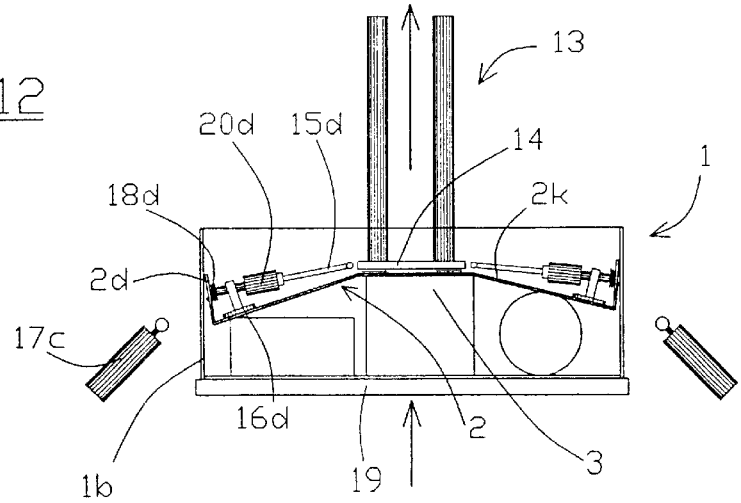

FIG. 12 shows that the ascending movement of the box 2 then produces, at the end of the progression, a lift of the tool 13, and the action of the support plates (support plate 16*d*, . . . ) on the central part 2*k* of the sheet 2 and the deformation of the central part is shown in a manner that the largest part of the lower side of the central part is pinned against the upper surface of the stack of objects 3. It is understood that the assemblies made of the mobile arms (mobile arm 15*d*, . . . ), the activators (activator 20*d*, . . . ) and the support plates (support plate 16*d*, . . . ) perform, under the action of their own weight, the function of counter-pressure mechanisms ensuring, at the end of the ascending progression of the elevator 19, a deformation of the fastening sheet 2, in a manner so that it approximately fits the form of the upper surface 6 of the stack of objects 3 housed in the box 1.

Figure 13:
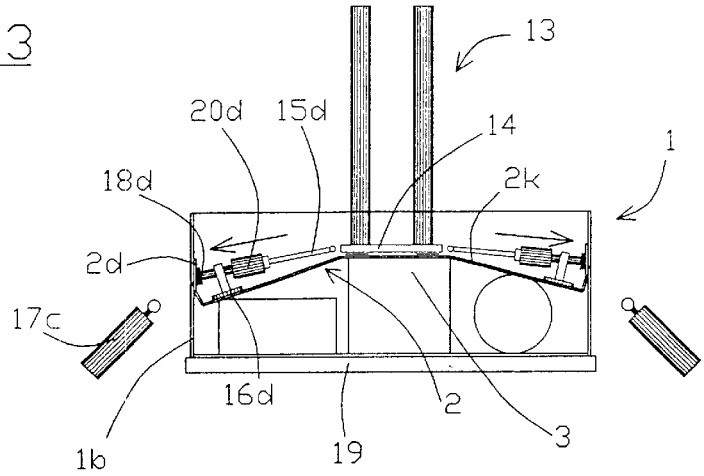

FIG. 13 shows the push of the support devices (support devices 18*d*, . . . ) induced by the control of the activators (activator 20*d*, . . . ) which can, for example, integrate a pneumatic jack in order to fold up the folding panels (folding panel 2*d*, . . .), in a manner so that the glued side of the folding panels comes in contact with the lateral sides (lateral side 1*b*, . . . ) of the box 1.

Figure 14:
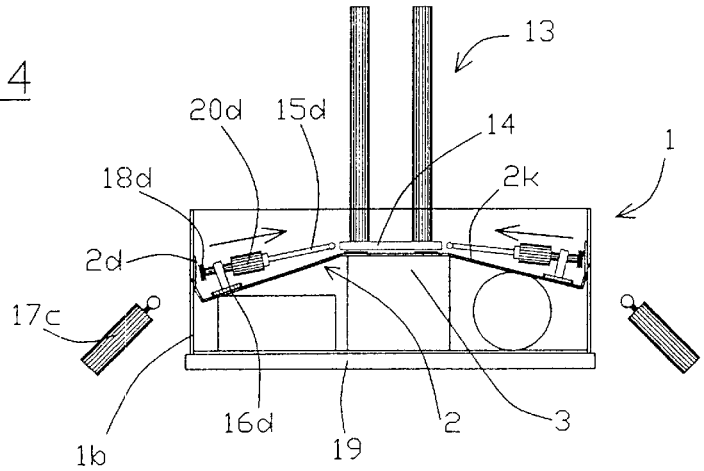

FIG. 14 shows, after drying of the bead of glue 4*d*, that allows the sheet 2 to connect solidly with the box 1, the loosening of the action of the suction of the support device (support device 18*d*, . . .) and the return of the activators (activator 20*d*, . . .).

Figure 15:
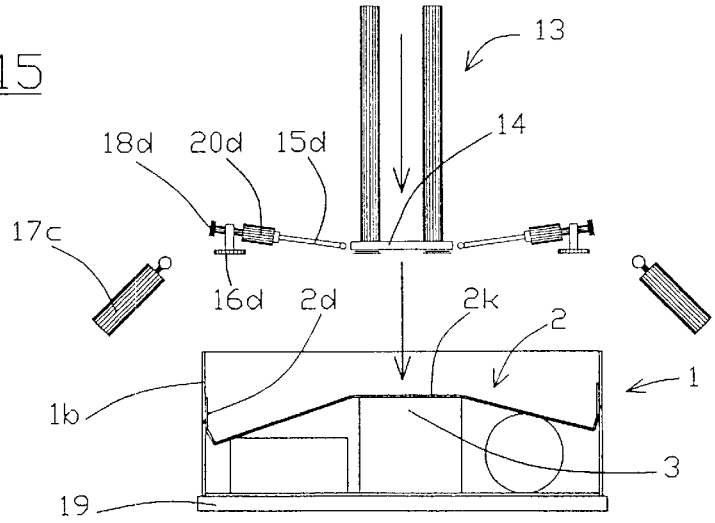

FIG. 15 shows the descent of the box 1 and the sheet 2, as well as the descent of the tool 13 into the initial position.

Figure 16:
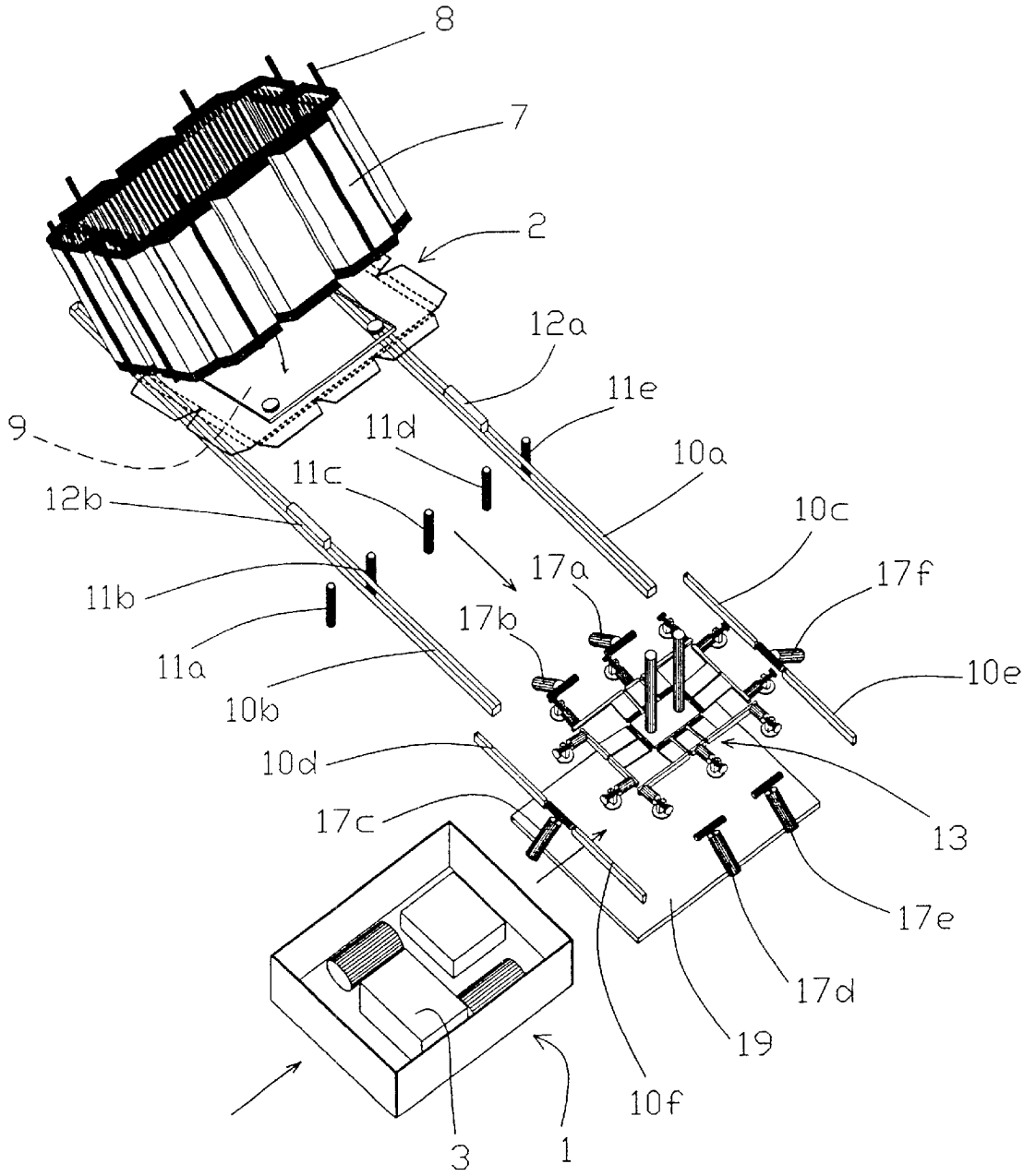
FIG. 16 is a schematic view of a machine according to the invention.

FIG. 16 is a view of the entire machine on which are shown the different elements described above. Also shown in FIG. 16 are a stack 7 of sheets used by the machine, which are stored in an inclined bin 8, and the mobile plate 9 equipped with suctions, the displacement of which makes it possible to disconnect the sheet located in the lower part of the bin from the stack of sheets and to arrange it on the horizontal plane of transfer. Finally shown is the box 1, in which the stack of various objects 3 has been previously arranged, before its introduction into the machine and its positioning on the elevator 19.

The different suctions of the machine are connected to a system for aspiration by automatic control.

A process and a machine that are very advantageous have been described, according to which the fastening sheet 2 is united by gluing on the inner side of the lateral walls 1*a*, 1*b*, 1*c*, 1*d* of the box 1. However, it is emphasized according to the invention that the fastening sheet can be affixed by other processes, for example, by stapling, the support devices 18*a*, 18*b*, 18*c*, and the activators 20*a*, 20*b*, 20*c*, . . . of the machine being replaced, for example, by staplers.

Figure 17:
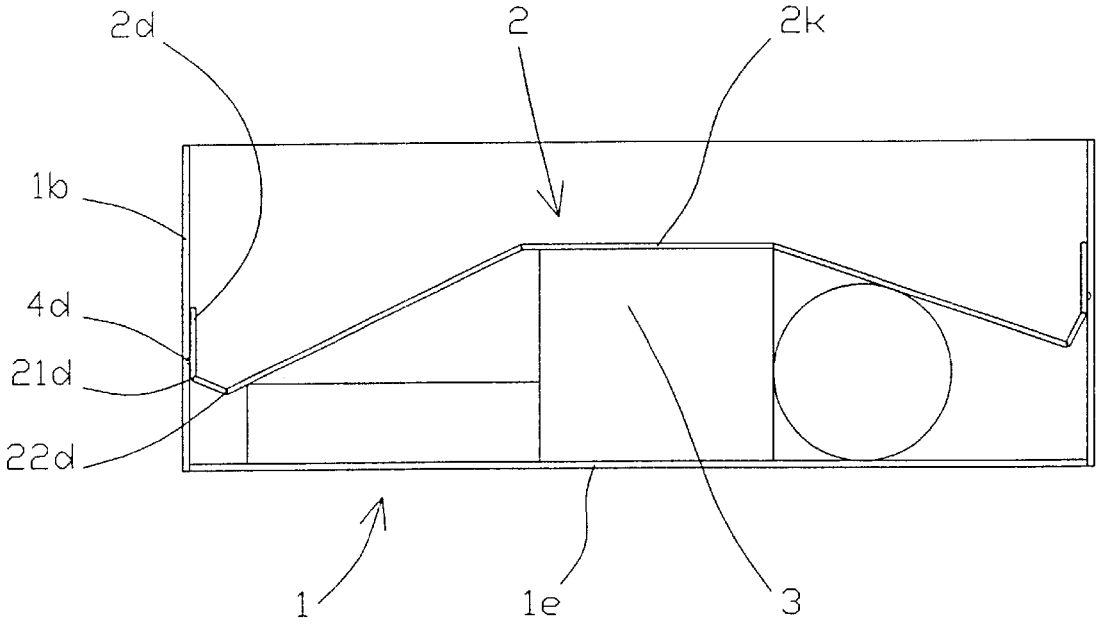
FIGS. 17 and 18 are two sectional views showing two examples of boxes after passing into the machine according to the invention.
Figure 18:
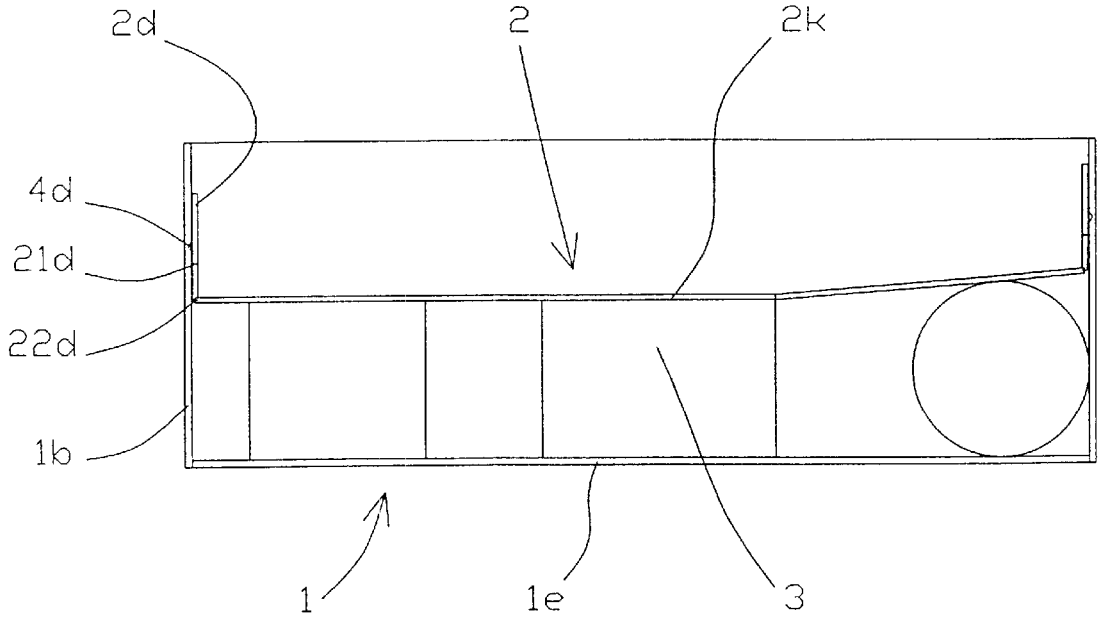

FIGS. 17 and 18 show two examples of the boxes after passing through the machine according to the invention.

FIG. 17 shows on the left side a stack of objects 3 whose upper surface is not planar. Shown as a result is the folding of the folding panel 2*d* along the folding line 21*d*, parallel to the joint 22*d* of the folding panel 2*d*. The folding reduces the surface of the folding panel 2*d* applied against the lateral side 1*b*, and makes it possible to use the surface thus available in order to compensate for the increase of the surface of the central part 2*k* of the sheet 2 connected by its deformation when it is placed in contact with the upper surface of the stack of objects.

FIG. 18 shows on the left side a stack of objects 3 whose upper surface is approximately planar. Shown as a result is the absence of folding of the folding panel 2*d* along the folding line 21*d*. The entirety of the surface of the folding panel 2*d* is thus applied against the lateral side 1*b*.

We claim:

1. A process for fastening of objects of varying heights into a box comprising:

forming a box bottom having a bottom surface and at least four lateral sides extending upwardly from said bottom surface, said bottom surface having length and width dimensions;

forming a sheet of rigid or semi-rigid flexible material, said sheet having a central part with length and width dimensions approximately equal to said length and width dimensions of said bottom surface, said sheet having a plurality of flexible folding panels jointedly connected to said central part and extending upwardly therefrom;

placing the objects of varying height onto said bottom surface of said box bottom, the objects of varying height having an uppermost surface;

pushing said sheet into said box bottom to any level below the top of said lateral sides until a bottom surface of said sheet contacts the uppermost surface of the objects;

pushing the folding panels respectively toward the lateral sides of said to any level below that of said lateral box bottom; and fixing the folding panels respectively to the lateral sides of said box bottom.

2. The process of claim 1, further comprising:

applying at least one bead of glue on said plurality of flexible folding panels prior to said step of pushing said sheet into said box, said step of fixing the folding panels comprising pasting the folded panels against an internal side of the lateral walls of said box bottom, said step of fixing further comprising drying the bead of glue so as to solidly fix said folding panels to said lateral walls of said box bottom.

3. The process of claim 1, step of forming the sheet comprising:

forming said sheet such that said plurality of flexible folding panels extend outwardly from said each side of said central part.

4. The process of claim 3, said step of forming said sheet comprising:

forming several flexible folding panels on each of said sides of said central part.

5. The process of claim 1, step of pushing said sheet comprising:

pressing said sheet at several locations on said central part against the uppermost surface of said objects so as to deform said central part in order to fit against the uppermost surface of the objects.

6. The process of claim 1, said step of forming said sheet comprising:

forming a plurality of joints such that said plurality of flexible folding panels are jointedly connected to said central part; and forming a plurality of folding lines respectively corresponding to said plurality of joints in parallel relationship thereto, said plurality of folding lines respectively positioned between the joint and an edge of said plurality of flexible folding panels opposite the respective joint.

7. The process of claim 1, further comprising:

storing a plurality of the sheets in a stack form of identical sheets within an inclined bin such that the sheet located in a bottom of said inclined bin is unstacked individually and arranged on a horizontal plane formed of several rails; and applying an arrangement of beads of glue on each of said plurality of flexible folding panels during a transfer of the sheet onto said horizontal plane.

8. The process of claim 1, said step of placing the objects comprising:

positioning said box bottom on an elevator;

lifting the box bottom on said elevator such that the uppermost surface of the objects contacts a lower side of said central part of said sheet, said sheet being held by a grasping device positioned above said elevator.

9. The process of claim 8, step of pushing said sheet comprising:

pressing said central part of said sheet by an ascending movement of said elevator against a counter-pressure mechanism applied to said central part of said sheet.

10. An apparatus for fastening objects of varying height within a box, the box having a bottom of square rectangular shape and at least four lateral sides extending upwardly from the bottom, the box having a fastening sheet formed of a rigid or semi-rigid flexible material, the fastening sheet having a central part with dimensions that are approximately equal to dimensions of the bottom, the fastening sheet having at least one flexible folding panel respectively on at least two opposing sides of the fastening sheet, the apparatus comprising:

a gluing means positioned adjacent the fastening sheet, said gluing means for applying beads of glue on a lower side of the folding panels;

a folding means positioned downstream of said gluing means, said folding means for folding the folding panels at an angle with respect to an upper side of the cental part; and an insertion means positioned downstream of said folding means, said insertion means for inserting and pushing the sheet into the box such that a lower side of the central part contacts an uppermost surface of the objects of varying height.

11. The apparatus of claim 10, further comprising:

a supporting means interposed between said folding means and said insertion means, said supporting means for supporting the folded folding panels subsequent to said gluing means and said folding means in a manner such that a non-glued side of the folding panels forms an acute angle with the upper side of the central part of the fastening sheet; and fixing means positioned downstream of said insertion means, said fixing means for pushing the folding panels so that the glued side thereof is applied against the lateral sides of the box.

12. The apparatus of claim 10, said insertion means comprising:

a pressing means for pressing the fastening sheet against the uppermost surface of the objects of varying heights so as to deform the fastening sheet within the box.

13. The apparatus of claim 10, further comprising:

an inclined bin means for the storage of the fastening sheets in a stack of identical sheets;

a mobile plate cooperative with said inclined bin means, said mobile plate having a suction means thereon which is positioned for releasing the fastening sheet located in a lower part of said inclined bin means from the stack of fastening sheets;

a horizontal transfer plane formed of a plurality of rails;

said gluing means comprising a gluing nozzle means located under said horizontal transfer plane and directed toward the folding panels thereon, said gluing nozzles means for deposited the bead of glue on the inner side of each of the folding panels during a transfer of the fastening sheet onto the horizontal transfer plane; and a mobile stop means positioned adjacent to said horizontal transfer plane, said mobile stop means for displacing the sheet from said horizontal transfer plane and for positioning the fastening sheet above the box.

14. The apparatus of claim 10, further comprising:

a tool means for positioning the fastening sheet within the box, said tool means comprising:

a grasping plate means positioned in a central zone of said tool means, said grasping plate having suctions thereon for contacting the fastening sheet by a vertical translation movement toward a bottom of said tool means in order to seat the fastening sheet;

a plurality of mobile arms that are spread out around said grasping plate means, said plurality of mobile arms being approximately the same number as a total number of the folding panels of the fastening sheet, said plurality of mobile arms being positioned approximately facing the location of each of the folding panels, each of said mobile arms having a support plate means thereon, said support plate being placed in contact with a location in the central part of the fastening sheet located near each of the folding panels by the vertical translational movement toward the bottom of said tool means;

supporting means having suctions thereon for supporting the folding panels in the folded position after the folding panels have been folded; and activator means cooperative with said supporting means and with said mobile arms, said activator means having an output for folding the folding panels by pushing the supporting means in a manner so that the glued side of the folding panels contacts the respective lateral sides of the box.

15. The apparatus of claim 10, further comprising:

a pushing means cooperative with said insertion means, said pushing means being spread out around the space occupied by the fastening sheet when it is located in a position which allows for the insertion into the box, said pushing means being arranged relative to and above the folding panels, said pushing means moving from a resting position in order to fold the folding panels toward the lateral sides of box bottom.

16. The apparatus of claim 14, further comprising:

an elevator means positioned so as to receive the box thereon, said elevator means being arranged below said tool means, said elevator means for lifting the box toward a position such that the fastening sheet can be inserted into the box by said insertion means.

17. The apparatus of claim 16, said tool means being mounted with a freedom of ascending movement such that said tool means can be guided toward a top by said elevator means, said tool means for deforming the fastening sheet and for pinning the fastening sheet against the uppermost surface of the objects by a vertical force produced by the action of said supporting means.

* * * * *